US005123812A

United States Patent [19]

Groenendaal, Jr. et al.

[11] Patent Number: 5,123,812

[45] Date of Patent: Jun. 23, 1992

[54] APPARATUS FOR ALIGNING A BLADE RING IN A STEAM TURBINE

[75] Inventors: John C. Groenendaal, Jr., Winter Springs, Fla.; Daniel T. Brantley, Mt. Holly, N.C.

[73] Assignee: Westinghouse Electric Corp., Pittsburgh, Pa.

[21] Appl. No.: 580,991

[22] Filed: Sep. 12, 1990

[51] Int. Cl.[5] ..... F01D 9/00; F01D 25/24

[52] U.S. Cl. ..... 415/209.2; 415/108; 415/126; 29/264; 29/271; 81/459

[58] Field of Search ..... 415/108, 126, 189, 209.2, 415/209.3, 214.1; 81/459; 29/264, 271

[56] References Cited

U.S. PATENT DOCUMENTS

| | | | |
|---|---|---|---|
| 1,007,107 | 10/1911 | Hulsmann | 81/459 |
| 1,453,913 | 5/1923 | Burdick | 29/271 |
| 1,458,076 | 6/1923 | Potts | 29/264 |
| 2,572,502 | 10/1951 | Maxwell | 29/271 |
| 2,916,813 | 12/1959 | Belanger | 29/264 |
| 3,498,727 | 3/1970 | Martin, Jr. et al. | 415/189 |
| 4,694,569 | 9/1987 | Colvell et al. | 29/264 |

FOREIGN PATENT DOCUMENTS

| | | | |
|---|---|---|---|
| 0107240 | 5/1939 | Australia | 81/459 |
| 0972115 | 5/1959 | Fed. Rep. of Germany | 415/108 |

OTHER PUBLICATIONS

American Machinist, "Tips for Shop Men", Jun. 20, 1946, p. 149.

*Primary Examiner*—Edward K. Look
*Assistant Examiner*—Christopher M. Verdier

[57] ABSTRACT

A detachable apparatus is provided which facilitates rotation and handling of an alignment dowel during its installation into a steam turbine cylinder. The apparatus consists of a body having a threaded portion and a handle. The threaded portion allows the apparatus to be attached to the dowel prior to assembly. An elongated nut is threaded onto the body of the apparatus and, after being tightened down against the dowel, locks the apparatus onto the dowel. The dowel can be rotated in the cylinder by applying torque to the handle of the apparatus or by engaging a wrench onto the elongated nut.

6 Claims, 4 Drawing Sheets

APPARATUS FOR ALIGNING A BLADE RING IN A STEAM TURBINE

BACKGROUND OF THE INVENTION

The current invention concerns an apparatus for aligning a blade ring to the cylinder of a steam turbine. More specifically, a tool for rotating and handling an alignment dowel during its installation into the steam turbine cylinder is provided.

In a steam turbine, the stationary vanes are fitted into circular rings, referred to as blade rings, housed within the turbine cylinder. In addition to holding the vanes, the blade rings form a shroud over the tips of the rotating blades. In order to prevent steam from leaking around the row of rotating blades, which would reduce the energy extracted from the steam, there is little radial clearance between the blade ring and the tips of the rotating blades. Moreover, during operation, differential thermal expansion between the stationary and rotating components reduces the radial clearance further. Thus, in order to prevent the rotating blade tips from contacting the blade ring, it is important that the blade ring be carefully aligned with respect to the rotor. Since the rotor is centered in a turbine cylinder, this means that the blade ring must be accurately aligned to the turbine cylinder.

Each blade ring is aligned to the turbine cylinder in the transverse direction by radial dowels at the 12 o'clock and 6 o'clock locations. The dowels are retained in close fitting holes in the turbine cylinder. The inboard end of each dowel features a key which inserts into a slot in the periphery of the blade ring. Alignment is achieved by specially machining each key so that, when inserted into the slot, the key locates the blade ring in its proper alignment. This alignment is maintained by welding the dowel to the turbine cylinder.

Although a close fit of the dowel key within the slot in the blade ring is desired in order to maintain accurate alignment, there is a clearance of approximately 0.076 mm (0.003 inch) between each side of the slot and the key. To ensure that the blade ring is properly aligned, it is important that the key be situated so that its faces are parallel to the sides of the slot. However, as a result of the clearance, it is possible to rotate the key slightly in the slot so that its faces are not parallel to the sides of the slot—that is, the key can be cocked, with opposing corners of the key contacting the sides of the slot. To ensure the dowel is not welded to the turbine cylinder with the key in this cocked position, a centering operation is performed during the assembly process. This centering operation involves rotating the dowel clockwise until contact with the sides of the slot is felt and scribing lines on the dowel and the turbine cylinder marking this orientation. The dowel is then rotated counterclockwise until contact is felt in that direction and a second line is scribed on the turbine cylinder in line with the line previously scribed on the dowel. The dowel is then rotated so that its scribe line is midway between the two scribe lines on the turbine cylinder and welded to the cylinder in this position.

Note that because of the close fit between the dowel and its retaining hole in the turbine cylinder, along with the presence of dirt and burrs in the hole, rotating the dowel during the assembly procedure often requires considerable torque. However, the method of applying torque must provide sufficient "feel" to enable the assembler to determine when contact between the key and the slot has occurred during the scribing operation.

The assembly procedure discussed above places four requirements on the dowel which must be addressed during its design: (i) it must be capable of being lifted and held while being inserted into the turbine cylinder, (ii) it must facilitate the application of substantial torque to turn the dowel, (iii) it must allow the torque to be applied in a manner which provides sufficient "feel" to determine when the key has contacted the sides of the slot, and (iv) it must allow the dowel to be accurately held in place during the scribing operation. Since the body of the dowel is round, it does not lend itself to the application of conventional box or open end wrenches. Although a pipe wrench is capable of supplying the necessary torque to turn the dowel, it would not satisfy requirements (iii) or (iv) above because of slippage inherent in the use of such wrenches. According to the prior art, the problem of wrench engagement was overcome by the use of an integral stub emanating from the outboard end of the dowel. Flats were milled on opposing surfaces of the stub to enable engagement by an open end wrench. In addition, a hole was drilled and tapped in the end of the stub to allow the attachment of a handle which facilitated lifting and handling of the dowel during assembly. Although this dowel design performed satisfactorily, as explained below, other constraints in the dowel design made the manufacturing of this integral stub undesirably expensive.

As previously mentioned, the dowels are retained by welding them to the turbine cylinder. A closure weld bead is placed around the periphery of the dowel where it projects through the turbine cylinder. In operation, substantial loads are transmitted to the weld bead from the turbine cylinder and the dowel, due to internal pressure in the turbine cylinder and differential thermal expansion between the blade ring and the turbine cylinder. In order to ensure that these loads do not result in the cracking of the closure weld, the dowel is made flexible in the vicinity of the weld, thereby reducing the loading imparted to the weld. This flexibility can be achieved by hollowing out the dowel at its outboard end—that is, in the portion of the dowel enclosed by the closure weld. In order to retain the integral stub, this hollowing out was limited to machining a circular groove in the end face of the dowel concentric of the center line of the dowel. The circular groove reduced the stiffness of the dowel to essentially that of a tube in the vicinity of the weld. The portion of the dowel remaining inside the circular groove formed the integral stub.

Machining of the circular groove requires an operation called trepanning, in which a cutting tool, attached to a rotating hollow cylindrical head, is fed into the dowel. Trepanning is a difficult and costly operation and results in frequent breakage of the tool. This is especially so in this case because the groove must often be two inches deep to obtain the necessary flexibility. Thus, as a result of the trepanning operation and the separate milling operation to produce the flats on the stub, the cost of manufacturing the dowel is extremely high.

Consequently, it is desirable to provide a means for rotating and handling the dowel which allows the required flexibility to be incorporated into the portion of the dowel in the vicinity of the weld, without the need for the expensive machining operations associated with the integral stub.

SUMMARY OF THE INVENTION

It is an object of the current invention to provide an apparatus for rotating an alignment dowel during installation of the dowel into the cylinder of a steam turbine.

It is a further object of the current invention that the apparatus be detachable from the dowel.

It is yet another object of the invention that the apparatus provide a means for lifting and handling the alignment dowel during its installation.

These objects are accomplished in a dowel used to align a blade ring in the turbine cylinder of a steam turbine. The dowel has a key formed on its inboard end which engages a slot in the blade ring. In order to properly orient the key in the blade ring slot, the dowel must be rotated in both the clockwise and counterclockwise directions relative to the turbine cylinder during installation of the dowel. According to the current invention, an apparatus is provided having a body comprised of a threaded portion and a handle portion. The apparatus is attached to the alignment dowel by screwing the threaded portion into a tapped hole in the outboard end of the alignment dowel. The handle portion of the apparatus serves as a convenient means for the lifting and handling of the dowel during installation. An elongated nut is attached to the threaded portion of the apparatus and, after being tightened down against the alignment dowel, locks the apparatus in place and allows rotation of the dowel relative to the turbine cylinder either by applying torque to the handle portion of the apparatus or engaging a wrench onto the elongated nut.

DESCRIPTION OF THE PREFERRED EMBODIMENT

Figure 1:
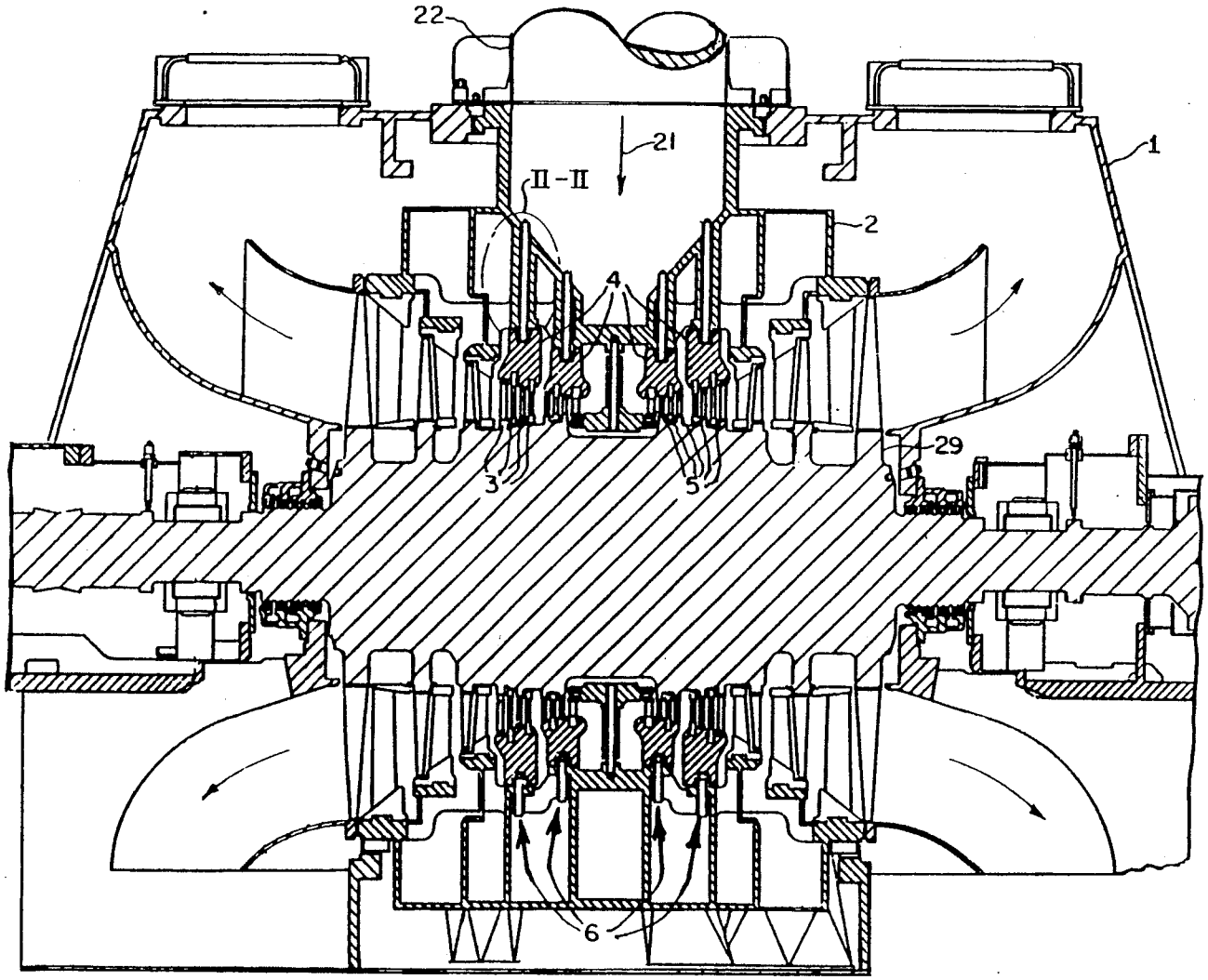
FIG. 1 is a longitudinal cross-section of a low pressure steam turbine.

There is shown in FIG. 1 a longitudinal cross-section of a low pressure steam turbine. The turbine is comprised of an outer cylinder 1 and an inner cylinder 2 surrounding a centrally disposed rotor 29. An inlet 22, through which steam 21 enters the turbine, is formed at the top of the outer cylinder. The entering steam is split into two streams, each of which flows longitudinally from the center of the turbine toward its ends. A plurality of rotating blades 3 and stationary vanes 5 are arrayed in alternating rows around the longitudinal steam flow paths. The rotating blades 3 are affixed to the periphery of the rotor. Blade rings 4 are enclosed by the inner cylinder in the inlet portion of the turbine. The blade rings are attached to the inner cylinder and encircle the rows of rotating blades. The stationary vanes are affixed to the inside surface of the blade rings. As previously discussed, the radial clearance between the blade ring inner surface and the tips of the rotating blades is small, necessitating careful alignment of the blade ring to the inner cylinder. Consequently, alignment dowels 6 are used at the 12 o'clock and 6 o'clock positions to align the blade rings to the inner cylinder in the transverse direction.

Figure 3:
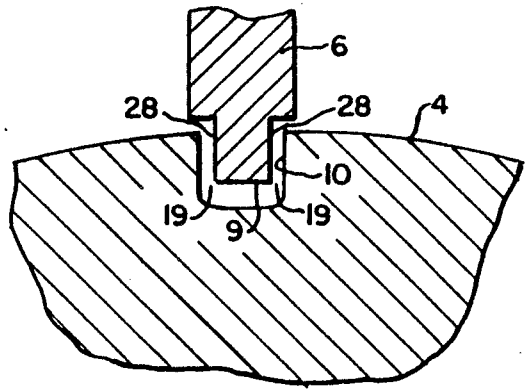
FIG. 3 is a cross-section of the inboard end of the alignment dowel taken through line III—III shown in FIG. 2.
Figure 2:
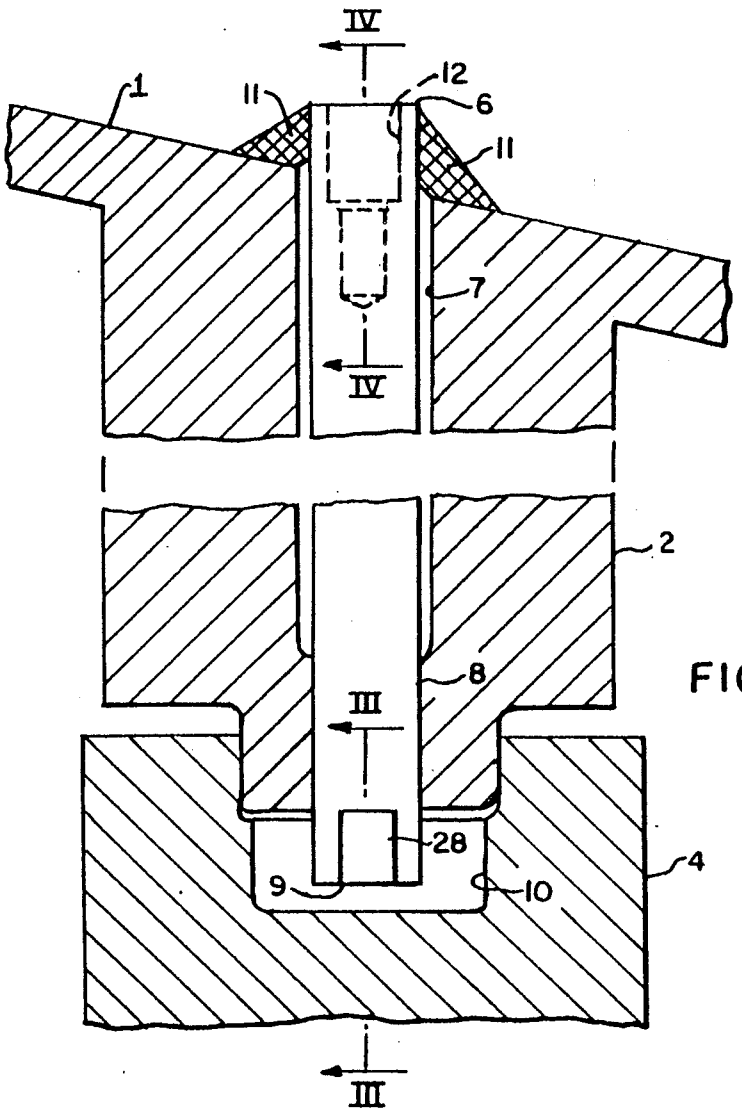
FIG. 2 is a detailed cross-section of the portion of the steam turbine, denoted II—II in FIG. 1, in the vicinity of an alignment dowel.

FIG. 2 is a detailed view of the turbine in the vicinity of an alignment dowel. The dowel 6, which is a cylindrically shaped member, is inserted radially through holes 7 and 8 in the inner cylinder. Hole 8 is close fitting to ensure that the dowel can be accurately positioned. As inserted, a portion of the dowel projects beyond the surface of the cylinder. As shown in FIG. 3, a key 9 is formed at the inboard end of the dowel by machining flat surfaces 28 on opposing sides of the dowel. The dowel engages the blade ring when the key is inserted into a slot 10 in the outer periphery of the blade ring. The flat surfaces 28 are specially machined for each blade ring as required to obtain the correct alignment. A small clearance 19 is provided on either side of the key to account for manufacturing tolerances. As previously discussed, correct positioning of the key in the slot is obtained by rotating the dowel clockwise and then counterclockwise through the clearance 19, marking the extreme positions of the dowel when rotated in each direction, and then rotating the dowel so that it is oriented at the midpoint between the two marks. The dowel is retained in the aligned position by a weld bead 11 deposited around the periphery of the dowel where it projects through the inner cylinder.

Figure 4:
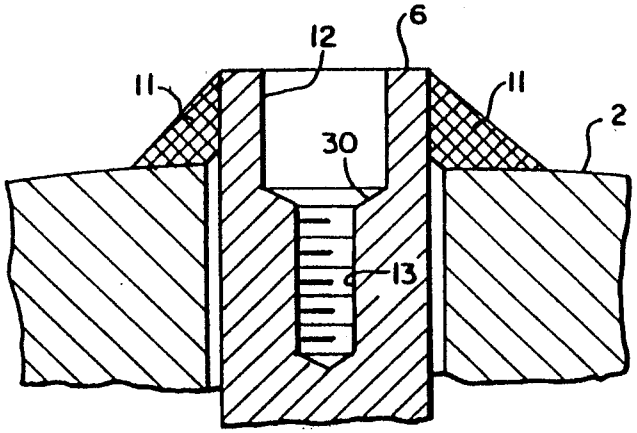
FIG. 4 is a cross-section of the outboard end of the alignment dowel taken through line IV—IV shown in FIG. 2.

As shown in FIG. 4, a circular recess 12 is formed in the outboard end of the dowel. The depth of the recess is greater than the length of the portion of the dowel projecting beyond the surface of the inner cylinder in order to obtain the desired flexibility in the vicinity of the weld. Since according to the current invention the integral stub is not required for wrench engagement, the recess 12 can be formed by a simple drilling or boring operation, as opposed to the more difficult trepanning operation used under the prior art. A hole 13 is drilled and tapped in the bottom 30 of the recess to enable attaching the special tool described below.

Figure 5:
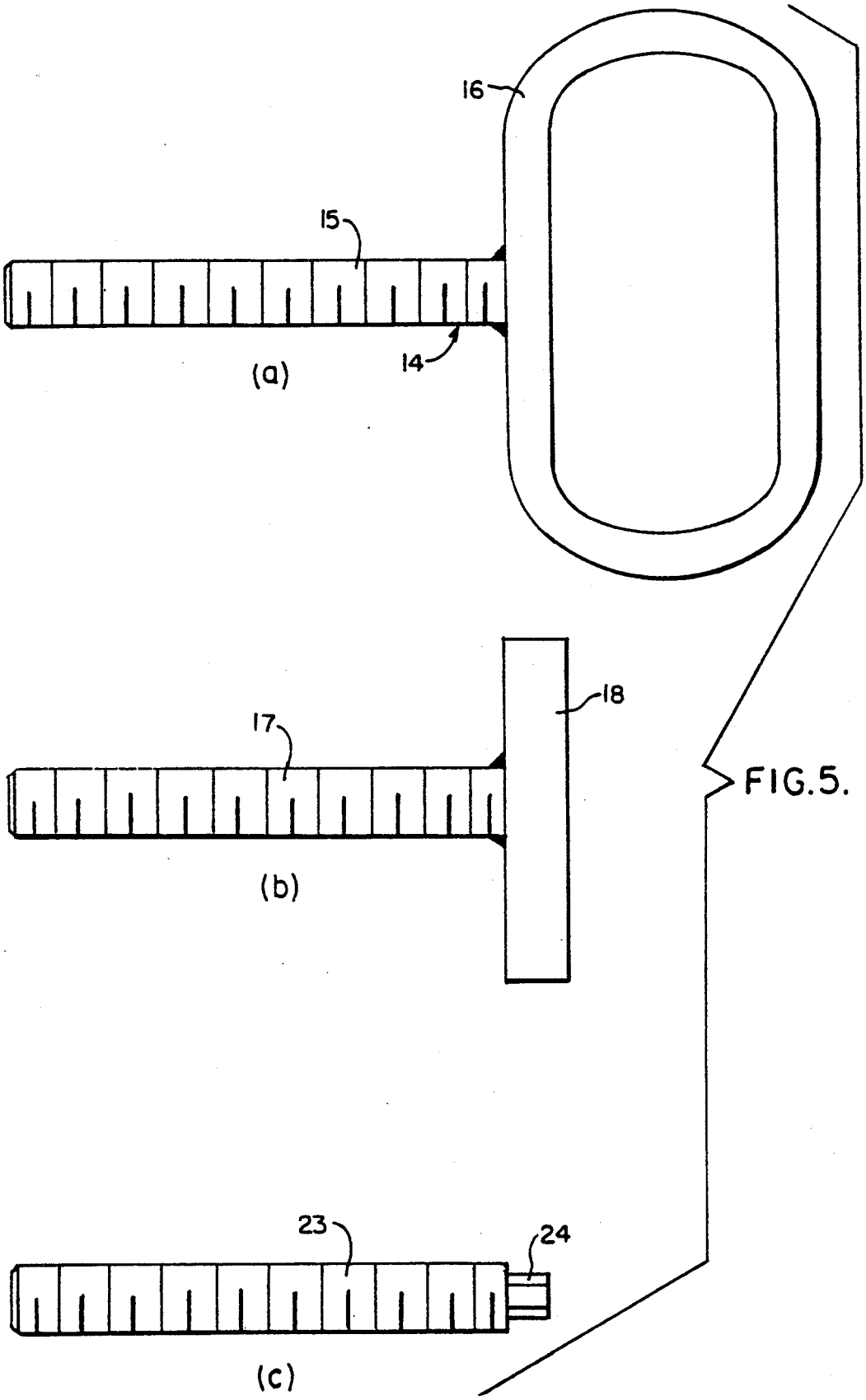
FIG. 5 shows three embodiments of the tool body.

According to the current invention, a special detachable tool is provided to facilitate the rotating and lifting of the dowel during assembly. The body of the tool serves as a lifting device by incorporating a handle portion. The tool body also incorporates a threaded portion. The threads on the threaded portion mate with those in the hole 13, allowing the tool to be attached to the dowel. In the preferred embodiment, the tool body 14 is comprised of an oval lifting link 16 welded onto the end of a threaded rod 15, as shown in FIG. 5(*a*). Alternatively, the tool body could be fabricated by welding a bar 18, which acts as a handle, onto a threaded rod 17, as shown in FIG. 5(*b*). A stud 23, as shown in FIG. 5(*c*), featuring a hex head 24 or screw driver slot (not shown) formed at the end of the threaded portion of the stud, could also be employed as the tool body—in this case a detachable handle (not shown) can be fixed onto the stud when it is desired to lift the dowel.

Figure 6:
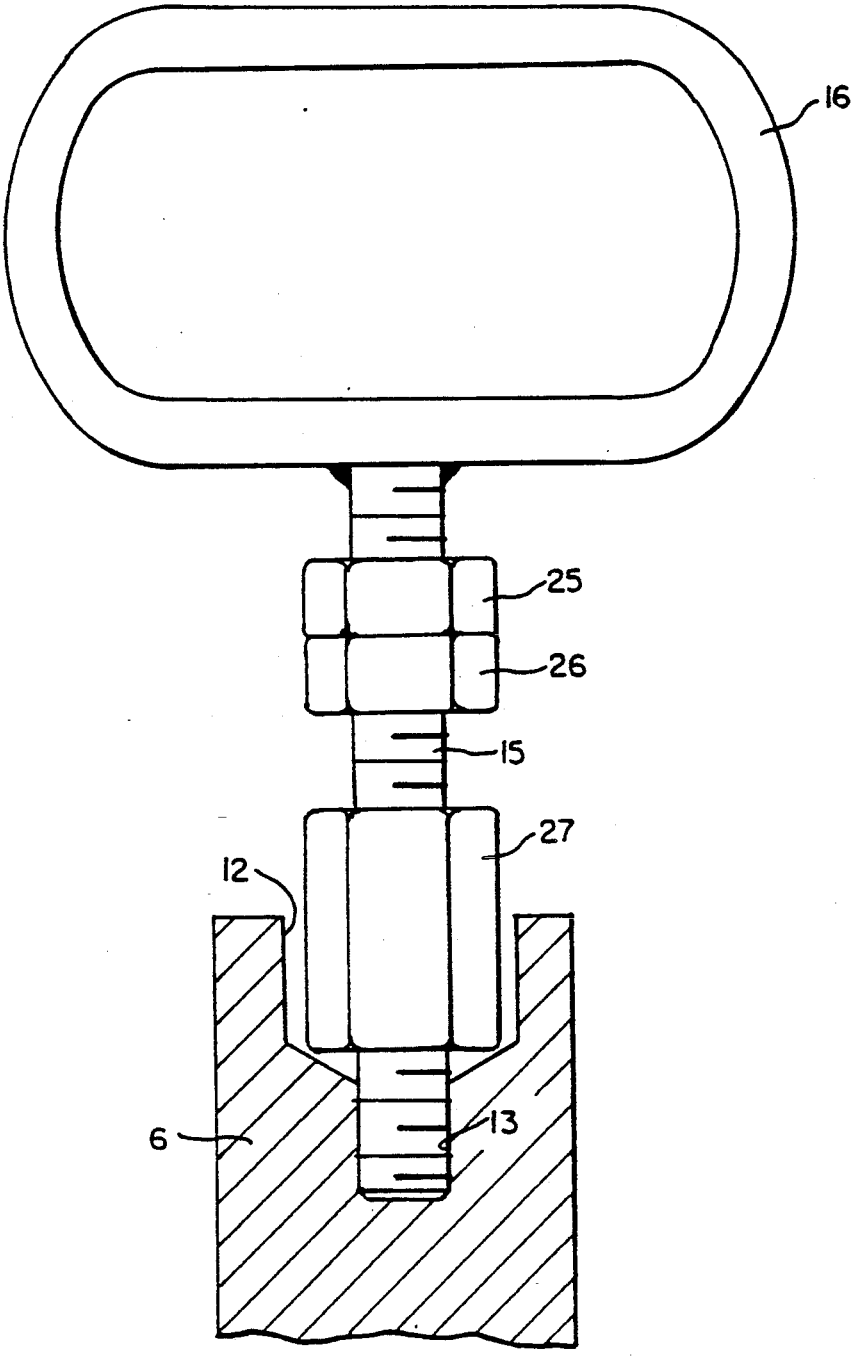
FIG. 6 shows the tool, employing the body shown in FIG. 5(*a*), as installed onto the outboard end of an alignment dowel.

The tool is further comprised of nuts 25, 26, 27, as shown in FIG. 6. The threads in the nuts mate with those on the threaded portion of the tool body, thus allowing the nuts to be coupled to the tool body. As shown in FIG. 6, nut 25 is threaded on first, then nut 26 and lastly nut 27. As explained below, nut 27 is elongated to allow wrench engagement when the nut is disposed in the recess 12.

Prior to inserting the dowel into the turbine cylinder, the tool is attached to the dowel by screwing the end of the threaded rod 15 into the tapped hole 13 in the outboard end of the dowel. Turning of the tool relative to the alignment dowel during this process is facilitated by nuts 25, 26, which allow the torque required to rotate the tool to be applied by a wrench engaged onto nut 25. During this screwing-in operation, nut 25 is tightened against nut 26, thereby preventing clockwise rotation of nut 25 relative to the tool body so that the torque applied to nut 25 turns the tool body, not the nut. Note that although nuts 25, 26 could be used to torque the tool onto the dowel using any of the too bodies shown in FIG. 5, the nuts need not be used for this purpose if the tool bodies shown in FIGS. 5(*b*) or (*c*) were employed. The tool body shown in 5(*b*) can be rotated by manually applying torque to the bar 18 and the tool body shown in FIG. 5*c*) can be rotated by a wrench engaged on the hex head 24.

After the tool has been tightened in hole 13, the elongated nut 27 is attached to the dowel by rotating the elongated nut on the threaded portion of the tool until the elongated nut is tightened down against the bottom of the recess 12 in the dowel. The outside diameter of the elongated nut 27 is less than the inside diameter of the recess 12, thereby allowing the nut to enter the recess. The length of the elongated nut 27 is greater than the depth of the recess 12, so that in the fully tightened position, the nut extends beyond the end of the dowel. Moreover, the portion of the nut which extends beyond the end of the dowel is long enough to facilitate engagement of an open end wrench (i.e., at least 1.3 cm (½ inch) extension beyond the the of the dowel).

Once the tool has been attached to the dowel, the lifting link can be conveniently employed to handle the dowel during its insertion into the turbine cylinder and during the engagement of the key 9 into the blade ring slot 10. Once the alignment of the blade ring to the cylinder has been verified, the dowel is rotated clockwise and counterclockwise to determine the correct orientation of the key within the blade ring slot, as previously discussed. The tool can be used to rotate the dowel by grasping the ends of the lifting link 16 and applying sufficient torque to rotate the dowel. In the alternative embodiments, the torque necessary to rotate the dowel can be applied by grasping the bar 18 or wrenching the hexhead 24. Rotation in the clockwise direction presents no problem since it merely serves to tighten the tool further. However, rotation in the counterclockwise direction can loosen the tool in the event the torque required to turn the dowel in the counterclockwise direction is greater than that required to loosen the tool—for example, because of a burr in hole 8. Should this occur, the torque applied to the tool would merely rotate it, not the dowel. This is prevented by the elongated nut which, by virtue of its being tightened down against the bottom of the recess, serves to lock the tool onto the dowel. Alternatively, rotation of the dowel can be accomplished by engaging a wrench onto the elongated nut and applying torque to the nut directly. In this case, nut 26 can be tightened down against the elongated nut to prevent its rotating relative to the tool body during counterclockwise rotation of the dowel.

Note that according to the current invention the tool can be removed from the dowel after it is welded to the turbine cylinder. Hence, a single tool is sufficient to install any number of dowels. Thus, not only is the machining of the dowel simplified by eliminating the aforementioned integral stub used in prior art dowels, only a single detachable tool is required to provide any number of dowels with means for lifting and rotation during the blade ring alignment process.

Although the current invention is explained as applied to a blade ring alignment dowel in a steam turbine, the invention is equally applicable to enable the handling and rotation of any radially oriented member inserted into the cylinder of a gas or steam turbine, if the member itself does not feature integral handling and rotation means.

We claim:

1. A turbine comprising:

a) a cylinder surrounding a centrally disposed rotor and enclosing an inner ring;

b) a dowel extending into said cylinder for aligning said inner ring thereto, said dowel having a first end having means for engaging said inner ring and a second end welded to said cylinder, a portion of said dowel adjacent said second end extending outboard of said cylinder by a length, a recess formed in said second end of said dowel and having a bottom in which a tapped hole is formed; and (c) a tool for lifting and rotating said dowel during its installation into said cylinder prior to said welding of said dowel thereto having (i) a handle and a threaded portion extending therefrom adapted to thread into said tapped hole and (ii) a nut threaded onto said threaded portion and adapted to be tightened down against said bottom of said recess when said threaded portion is screwed into said tapped hole, thereby preventing rotation of said tool relative to said dowel.

2. The turbine according to claim 1, wherein said recess is approximately cylindrical and has an inside diameter, and wherein said recess bottom defines a recess depth that is greater than said length of said extending portion of said dowel.

3. The turbine according to claim 2, wherein said nut has a length an dan outside diameter, said nut length being greater than said depth of said recess and said nut outside diameter being less than said inside diameter of said recess.

4. A steam turbine comprising:

(a) a turbine cylinder surrounding a centrally disposed rotor;

(b) a ring enclosed by said turbine cylinder;

(c) means for aligning said ring with said turbine cylinder, said aligning means being essentially radially oriented and having first and second ends, said first end having means for engaging said ring;

(d) detachable means for lifting said aligning means having a threaded portion and a handle portion, said aligning means having means for attaching and detaching said lifting means thereto comprising a tapped hole formed in said second end of said aligning means;

(e) means for rotating said aligning means relative to said turbine cylinder in both a first direction and a second direction opposite to said first direction comprising a first nut having threads formed therein;

(f) means for attaching and detaching said rotation means from said aligning means comprising said threads formed in said first nut mating with said threaded portion of said detachable lifting means;

(g) means for turning said detachable lifting means relative to said aligning means comprising second and third nuts threaded onto said threaded portion of said detachable lifting means, thereby facilitating said attachment of said detachable lifting means to said aligning means; and (h) means for preventing rotation of said rotation means relative to said aligning means in said first direction comprising said second nut threaded onto said threaded portion of said detachable lifting means being tight against said first nut, thereby facilitating rotation of said aligning means in said first direction.

5. A steam turbine comprising:

(a) a turbine cylinder surrounding a centrally disposed rotor;

(b) a ring enclosed by said turbine cylinder;

(c) means for aligning said ring with said turbine cylinder, said aligning means being essentially radially oriented and having first and second ends, said first end having means for engaging said ring, said aligning means affixed to said turbine cylinder by a weld surrounding said second end of said aligning means, an approximately circular recess having an inside diameter and a depth formed within said second end of said aligning means, said recess being concentric with and encircled by said weld, thereby increasing the flexibility of said aligning means in the vicinity of said weld;

(d) detachable means for lifting said aligning means having a threaded portion and a handle portion, said aligning means having means for attaching and detaching said lifting means thereto comprising a tapped hole formed in said second end of said aligning means;

(e) means for rotating said aligning means relative to said turbine cylinder in both a first direction and second direction opposite to said first direction comprising a first nut having threads formed therein, said first nut having an outside diameter and a length, said outside diameter of said first nut being less than said inside diameter of said recess, thereby enabling said first nut to be disposed within said recess, said length of said nut being greater than said depth of said recess;

(f) means for attaching and detaching said rotation means from said aligning means comprising said threads formed in said first nut mating with said threaded portion of said detachable lifting means;

(g) means for turning said detachable lifting means relative to said aligning means comprising second and third nuts threaded onto said threaded portion of said detachable lifting means, thereby facilitating said attachment of said detachable lifting means to said aligning means; and (h) means for preventing rotation of said rotation means relative to said aligning means in said first direction, thereby facilitating rotation of said aligning means in said first direction.

6. A turbine comprising:

(a) a cylinder surrounding a centrally disposed rotor and having an outer surface, a radial hole being formed in said cylinder;

(b) a cylindrical member, said cylindrical member capable of insertion into said radial hoe, said cylindrical member having first and second ends, a portion of said second end projecting a length beyond said outer surface of said cylinder in the vicinity of said radial hole when said cylindrical member is inserted into said radial hole, a recess formed in said second end, said recess having an inside diameter and a bottom defining a recess depth, said depth of said recess being grater than said length of said portion projecting beyond said cylinder a tapped hole being formed in said bottom of said recess;

(c) a tool having first and second ends, a threaded portion formed at said first end and a handle portion formed at said second end, said threads in said threaded portion mating with said threads in said tapped hole;

(d) first, second and third nuts threaded onto said threaded portion of said tool, said first nut being closest to said second end, said third nut being closest to said first end and said second nut being between said first and third nuts, said third nut having a diameter and a length;

(e) said diameter of said third nut being less than said inside dimension of said recess, said length of said third nut being greater than said depth of said recess, said third nut being capable of being tightened down against said bottom of said recess when said threaded portion of said tool is screwed into said tapped hole, thereby enabling rotation of said cylindrical member relative to said cylinder by engaging a wrench on said third nut;

(f) said second nut being capable of being tightened down against said third nut, thereby preventing counterclockwise rotation of said third nut relative to said tool; and (g) said first nut being capable of being tightened against said second nut, thereby enabling rotation of said tool relative to said cylindrical member by engaging a wrench on said first nut.

* * * * *